US012606943B2

(12) United States Patent
Kolb

(10) Patent No.: US 12,606,943 B2
(45) Date of Patent: Apr. 21, 2026

(54) KNITTED PART

(71) Applicant: medi GmbH & Co. KG, Bayreuth (DE)

(72) Inventor: Marvin Kolb, Emtmannsberg (DE)

(73) Assignee: medi GmbH & Co. KG, Bayreuth (DE)

( * ) Notice: Subject to any disclaimer, the term of this patent is extended or adjusted under 35 U.S.C. 154(b) by 0 days.

(21) Appl. No.: 18/651,528

(22) Filed: Apr. 30, 2024

(65) Prior Publication Data

US 2024/0426031 A1 Dec. 26, 2024

(30) Foreign Application Priority Data

May 4, 2023 (EP) ..... 23020210

(51) Int. Cl.
*D04B 1/26* (2006.01)
*D04B 1/10* (2006.01)
*D04B 1/22* (2006.01)

(52) U.S. Cl.
CPC ..... *D04B 1/102* (2013.01); *D04B 1/22* (2013.01); *D04B 1/26* (2013.01); *D10B 2403/0114* (2013.01); *D10B 2509/028* (2013.01)

(58) Field of Classification Search
CPC ..... D04B 1/26; D04B 1/108; D04B 1/102; D04B 1/04; D04B 1/265; D04B 9/48; D04B 9/46; D04B 9/52
See application file for complete search history.

(56) References Cited

U.S. PATENT DOCUMENTS 2,100,861 A * 11/1937 Lochhead ..... D04B 1/06 66/169 A
3,154,933 A * 11/1964 Holder ..... D04B 1/26 66/172 E
4,019,350 A * 4/1977 Schmidt ..... D04B 1/102 66/196
4,034,581 A * 7/1977 Swafford ..... D04B 1/26 66/136
4,216,662 A * 8/1980 Harris, Jr. ..... D04B 1/102 66/185
4,520,635 A 6/1985 Shields et al.
4,589,267 A * 5/1986 Barbee ..... D04B 1/02 66/42 A
4,672,825 A * 6/1987 Yasukawa ..... D04B 1/04 66/194

(Continued)

FOREIGN PATENT DOCUMENTS

WO 2019224846 11/2019

*Primary Examiner* — Danny Worrell
(74) *Attorney, Agent, or Firm* — Rimon PC

(57) ABSTRACT

Knitted part in particular circular knitted fabric consisting of at least one stitch-forming thread as well as at least one first and second plating thread, wherein in order to form a first cushioning layer the first plating thread is plated in a stitch-forming manner at least in sections in the stitch course direction on the basic knitting thread and lies floating over one or more basic knitting stitches formed by the basic knitting thread and in order to form at least one second cushioning layer the second plating thread is plated in a stitch-forming manner at least in sections in the stitch course direction (MR) on the basic knitting thread or the first plating thread and lies floating over one or more stitches or float stitches formed by the first plating thread.

20 Claims, 5 Drawing Sheets

(56) References Cited

U.S. PATENT DOCUMENTS

| | | | | |
|---|---|---|---|---|
| 7,677,061 | B2 * | 3/2010 | Mori | D04B 1/26 66/185 |
| 8,973,411 | B2 * | 3/2015 | Gaither | A61F 13/08 2/241 |
| 10,876,232 | B2 * | 12/2020 | Nishigaki | D04B 1/04 |
| 11,542,641 | B2 * | 1/2023 | Atmanspacher | D04B 1/04 |
| 11,629,439 | B2 * | 4/2023 | Tannebaum | D04B 1/04 66/185 |
| 2019/0153639 | A1 | 5/2019 | Nishigaki | |

* cited by examiner

KNITTED PART

FIELD OF THE INVENTION

The present invention relates to a knitted part, preferably to a circular knitted part according to the preamble of claim 1.

BACKGROUND OF THE INVENTION

Such knitted articles are used in particular for forming arm or leg garments, in particular socks, stockings or so-called sleeves. These articles are also used regularly for compression therapy. For this purpose, the compression articles have at least one, preferably a plurality of compression areas which serve to apply pressure specifically to the body of a patient. The pressure applied to the body of a patient is in this case designated as compression. The aim of such compressive articles is to relieve the pressure on a damaged venous and/or lymph system of a patient particularly in a medical usage. As a result of the pressure supplied, increasing swelling of the limbs is avoided, the removal of venous blood and lymph is improved and the blood supply is increased. When these compressive articles are used in the sports area, these bring about an improvement in performance or an improved regeneration.

RAL-GZ 387 of the Quality Mark Association exists for the manufacture, in particular for the measurement and quality assurance of compressive arm or leg stockings for medical application. From the test determinations of the RAL it can be deduced how, for example, the pressure of a compression stocking on a leg is to be determined. Testing on the HoSy measuring device, in particular compression testing device (Hohenstein Institute) is proposed as measurement means. Testing is carried out by measuring the tension at a plurality of measurement points which varies depending on the respective stretchability of the knitted fabric, i.e. depending on the elasticity of the knitted fabric. The compression is ultimately calculated from the tension.

In addition to the previously described compressive articles for compression therapy, in particular for lymph or oedema therapy, bandages are also known, for example, in the form of ankle or knee joint bandages which usually also consist of a tubular and preferably compressive knitted part.

Now it is further known to equip the initially described knitted parts or articles with cushioning to give the knitted parts cushioning or damping properties. For this purpose it is known that the knitted parts themselves form the cushioning, in particular due to a technical knitted structure. In this case, a cushioning thread is usually inserted into the basic knitted fabric produced by a basic knitting thread.

Such a knitted part, in particular knitted clothing item for legs with a cushioning on the inner side, in particular in the form of a compressive stocking, is known for example from EP 3 575 463 B1.

SUMMARY OF THE INVENTION

In this case, the clothing item for legs is preferably configured as stockings, pant legs, leggings or trousers and has a cushioning on the inner side, wherein this is configured in such a manner that this is arranged between the two muscle heads of the gastrocnemius muscle when the clothing item for legs is worn. Thus, when viewed in the circumferential direction the inner side of the clothing item for legs is partially offset inwards. This at least first cushioning extends in the worn state of the clothing item for legs additionally at least partially along the Achilles tendon and overlaps this. Preferably the clothing item for legs has at least a second cushioning which in the worn state of the clothing item for legs extends at least partially along the shin bone and overlaps this. A third cushioning is additionally provided for the toe region, the heel and/or the sole of the foot.

The first, second and third cushioning is preferably formed by a knitted section in the basic knitted fabric which differs from a region adjoining the cushioning in relation to its type of binding. In this case, the plurality of cushionings are preferably formed from a plush, in particular sandwich plush. In a plush an additional plush thread is plated onto a basic knitting thread forming plush loops. These plush loops thus formed protrude out from the knitted fabric and form an additional cushioning layer.

A further knitted part, preferably also known as clothing item for legs is known for example, from EP 3 375 921 A1.

The knitted part here comprises two different plush loop shapes made of two different plush threads, wherein the two plush loop forms differ in their height. That is, that the plush loops of the first shape are higher and longer than the plush loops of the second shape and consequently the first plush loops project further from the plane of the basic knitted fabric than the second plush loops. This has the result that a multilayer structure is formed on the knitted part according to the invention. The first layer or plane forms the basic knitted fabric. The second layer or plane forms the shorter plush loops which protrude from the basic knitted fabric whereas the third layer or plane forms the longer plush loops which protrude even further from the knitted fabric and project beyond the first plush loop plane. As a result, inter alia, the cushioning or damping effect of the knitted part can be improved.

It is found to be a disadvantage of these configurations of the knitted part, in particular of the incorporated cushionings and the formation of plush loops that the strength or the thickness of the knitted fabric is increased substantially. As a result of the formation of a plurality of loops, preferably on the knitted fabric inner side, the strength or thickness of the knitted fabric is increased substantially. The plush loops or plush loops project far from the basic knitted fabric. In this case, the cushioning or damping property of the knitted part is significantly improved but this is only unsatisfactory taking into account and in relation to the increase in the knitted fabric thickness. The background to this is that the plush loops form intermediate spaces which have no effect on the cushioning or damping properties but have a substantial influence on the knitted fabric thickness.

It has also proved disadvantageous that the formation of a cushioning by a plush technique is associated with an enormous consumption of thread and therefore material. In order to form the individual plush loops which protrude from the knitted fabric, a multiple of the thread lengths is required compared with the formation of a basic knitting stitch. This has the result that this type of formation of a cushioning on a knitted part is very cost-intensive, in particular as a result of the high material consumption but in particular as a result of the associated long running times of the knitting machines. As a result, this type of cushioning is not very sustainable due to the large use of resources.

It is also disadvantageous that by incorporating a plush into a knitted part, the climate and moisture management of the knitted part deteriorates substantially. Due to incorporation of large quantities of thread material into the basic knitted part, this is strongly influenced in its breathing activity. The knitted part is not very permeable to air, for example, due to the numerous plush loops. In addition, this also has the result that a large quantity of moisture is stored in the knitted part, in particular in the thread material of the plurality of plush loops and the intermediate spaces formed. This in turn additionally results in poor moisture management.

Finally, however, the formation of the cushioning by the plush knitting technique, in particular the so-called sandwich plush, also has the disadvantage that this is liable to wear. On the one hand, the plush loops with the long loops which are arranged on the left side of the goods, can themselves easily be pulled from the knitted fabric. On the other hand, an undesirable and so-called pilling regularly occurs on the right side of the goods, i.e. the outer side of the knitted part as a result of the necessarily very loose incorporation of the plush thread to form plush loops. Pilling is understood as the formation of small papules and fluff. These are formed by loose fibres which have been released from the knitted fabric by friction.

It is therefore the object of the present invention to provide a knitted part which avoids the disadvantages from the prior art, in particular significantly improves the cushioning property or the damping property of the knitted part and thus the wearing comfort, particularly with a reduced knitted fabric thickness compared to the solutions known from the prior art.

According to one exemplary embodiment, the knitted part according to the invention, in particular the circular knitted fabric, consists of at least one stitch-forming basic knitting thread as well as at least one first and second plating thread, wherein the first plating thread plates in a stitch-forming manner to form a first cushioning layer at least in sections in the stitch course direction on the basic knitting thread and lies floating above one or more basic knitting stitches formed by the basic knitting thread and wherein the second plating thread plates in a stitch-forming manner to form at least one second cushioning layer at least in sections in the stitch course direction on the basic knitting thread or the first plating thread and lies floating above one or more stitches or float stitches formed by the first plating thread. By this means a cushioned knitted part is formed consisting of at least two cushioning layers. The at least two cushioning layers are substantially formed by the individual and plurality of float stitches of the first and second plating thread, which come to rest one above the other on the left goods side of the knitted part, i.e. on the inner side. The individual float threads of the first and second layer can each be seen as individual cushion segments which in total results in a flat cushioning. The knitted part can naturally also be produced on a flat bed knitting machine as flat knitted fabric.

According to a second exemplary embodiment, the at least one first and second plating thread are jointly plated onto stitches formed by the basic knitting thread in a stitch-forming manner. By this means the strength or thickness of the knitted part at these points or stitches is only changed slightly or increased compared to the sections with the first and second cushioning layer. As a result it is possible to form one or more channels on the knitted part, in particular on the inner side or inside the cushioning, These can serve in particular to ventilate the knitted fabric or the cushioning.

Preferably the previously described stitches formed by the basic knitting threads on which the first and second plating thread is plated jointly in a stitch-forming manner is arranged offset in the stitch wales direction from stitch course to stitch course in the knitted part, preferably by an offset by one stitch wale. This enables the formation of a ventilated cushioning with ventilation channels or profiles running obliquely to the stitch wales direction.

According to a second exemplary embodiment, at least one elastic weft thread is inserted into the stitches of the knitted part formed by the basic knitting thread via catch and floating and/or is knitted with these in a stitch-forming manner. By this means compressive properties are imparted to the knitted part with the result that it can be used for compression therapy as described initially.

Particularly preferably the floating of the weft thread and the floating of the first and/or second plating thread is accomplished jointly via stitches formed by the basic knitting thread. As a result, the strength or thickness of the knitted part, i.e. the strength of the cushioning is increased significantly at these points or stitches. This enables the formation of, for example, punctuate or rib-shaped elevations in the knitted fabric. These elevations impart to the knitted part an at least locally massaging effect on the human body of the wearer which is frequently expedient or even desired for therapeutic reasons.

According to a third exemplary embodiment, the number of successive stitches above which the second plating thread lies in a floating manner is greater, preferably by a stitch, than the number of successive stitches above which the first plating thread lies in a floating manner. The length of the plurality of individual cushioning segments is determined by the number of successive float stitches of the first and second plating thread. Preferably in this case the first plating thread is floated above one stitch. The second plating thread preferably lies in a floating manner above two stitches. Particularly preferably the number of successive stitches above which the second plating thread is floated in a knitting machine with up to 240 needles is between 2 to 10 stitches, preferably 2 to 6 stitches and in a knitting machine with more than 240 needles, between 2 to 12 stitches, preferably also 2 to 6 stitches.

According to a further exemplary embodiment, the at least one basic knitting thread and preferably the first plating thread consists of a moisture-transporting yarn and the second plating thread consists of a moisture-absorbing yarn. The interplay between moisture absorption and transport is particularly important for the climate-regulating configuration of the knitted part. For this purpose, the second plating thread preferably consists of several fibres having substantially rounded cross-sections which therefore ensure a large contact area of the thread for resting on the skin of a wearer. The at least one basic knitting thread and preferably the first plating thread preferably consist of a plurality of interspun profile fibres. The profile fibres which have channels for transporting moisture can therefore effectively absorb the moisture from the second plating thread and conduct it further.

According to a further exemplary embodiment, the knitted part comprises a third plating thread, preferably a pattern or function thread which, at least in sections in the stitch course direction, plates in a stitch-forming manner on the basic knitting thread and/or on the first plating thread and/or the second plating thread and/or lies in a floating manner above these threads. The pattern thread is preferably configured to be a different colour from the remaining threads. The function thread is characterized for example by a particular adhesive property. This can be fabricated, for example, from silicone, elastane or rubber.

According to a further exemplary embodiment, the plurality of plating threads are only incorporated the knitted part in sections in the stitch course direction. The ends thereof are thereby locked in the basic knitting stitches of the knitted part. The locking is accomplished by forming a stitch, where the thread ends protrude from the stitches formed by the basic knitting thread.

According to a further exemplary embodiment, the basic knitting thread and the plurality of plating threads consist of plastic, in particular polyamide, polyester or polyurethane or of a natural fibre, in particular wool. In this case, the at least one basic knitting thread preferably has a yarn count of 30 to 700 dtex, the plurality of plating threads preferably have a yarn count of 30 to 300 dtex and the at least one weft thread preferably has a yarn count of 200 dtex to 700 dtex.

Particularly preferably the knitted part is a stocking, in particular an arm or leg stocking, with or without hand or foot part, a sock, a glove, a bandage or a preferably compressive element of an orthesis. When forming the knitted part as a stocking or sock, the at least one first and second cushioning layer is preferably incorporated in a sole, calf, heel, toe and/or Achilles tendon area.

Particularly preferably the compressive pressure values produced by the knitted part are between 5 and 60 mmHg, preferably between 10 and 45 mmHg, particularly preferably between 15 and 25 mmHg. The said compression values, in particular for the compressive arm and leg stockings, can be determined by the initially described measurement instructions and measurement method, in particular according to RAL-GZ 387 of the Quality Mark Association and using the HoSy measuring device (Hohenstein Institute).

The present knitted part is characterized by a series of considerable advantages.

Due to the formation of the knitted part with at least two plating threads which form a first and second cushioning layer, this being substantially due to the plurality of float stitches of the first and second plating thread, an extremely flat cushioning with particularly high cushioning and damping properties is created. This brings with it the advantage that the cushioning is not very bulky, preferably on the inner side of the knitted fabric. This is particularly advantageous when the knitted part is configured as an item of leg clothing, in particular as a stocking with a foot part. Due to the not very bulky knitted part according to the invention, the fit of a foot of a wearer in a shoe, i.e. the fitting, is only slightly, as far as not at all, negatively influenced, this being accompanied by improved wearing comfort due to the cushioning formed, in particular due to the plurality of cushioning layers.

A further advantage of the invention is the better adhesion of the cushioned knitted fabric to the skin of the wearer, for example, to the sole of the foot. This is because due to the knitted fabric according to the invention, in particular due to the plurality of float stitches lying transversely to the knitting direction, a substantially increased amount of thread material, for example compared to a cushioning made of plush, comes to rest on the skin of the wearer.

In addition, compared with the prior art, in particular compared with a plush knitted fabric, the cushioned knitted part according to the invention is substantially less prone to wear, for example, due to so-called pilling. The plating threads to form the cushioning are substantially tauter and firmer and incorporated closer together in the stitches of the basic knitted fabric. No loops, loops or loops are therefore present which protrude from the knitted fabric and are therefore prone to wear as is in particular the case with the formation of a plush.

A substantial advantage compared with the known solutions is also the significantly better climate or moisture management of the knitted part. As a result of the formation of the cushioning, in particular the first and second cushioning layer, due to the plurality of float stitches, significantly less thread material is used to form the cushioning. This has the result that the knitted fabric is more breathable. A better circulation of air can therefore take place through the cushioned knitted fabric. The channels preferably additionally formed on the knitted part or in the cushioning additionally support this circulation. In addition, substantially less moisture can be stored in the thread material itself. Also fewer intermediate spaces are formed in which the moisture can accumulate.

It is additionally advantageous that due to the significantly reduced thread consumption, the cushioning is substantially most cost-effective to manufacture. This is due to the significantly shorter machine run time required to form the cushioning according to the invention on the knitted part. This new type of formation of a cushioning on a knitted part is also substantially more sustainable than the solutions known from the prior art.

Finally it should also be noted that due to the formation of a cushioning with two cushioning layers, in addition to the advantage of significantly improved cushioning or damping properties, there is also the advantage that cushionings with individual cushioning strengths can be formed. As a result, a cushioning can be adapted in some regions and individually to the requirement within the knitted part. In addition, multi-dimensional structures, for example, recesses or elevations can thus be formed to form channels for air circulation or ribs, in particular for massaging purposes.

The invention is explained hereinafter with reference to several exemplary embodiments and in conjunction with the appended drawings.

DETAILED DESCRIPTION

Figure 1:
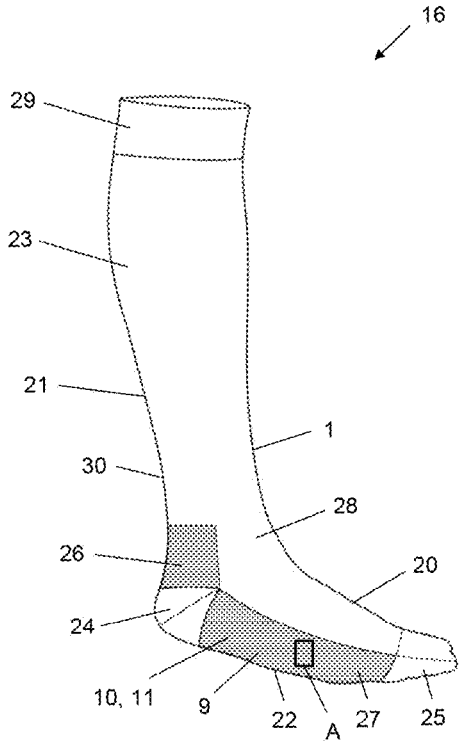
FIG. 1 shows a first exemplary embodiment of a knitted part according to the invention configured as an item of leg clothing, in particular as a knee-high stocking, in side view.

As can be seen in FIG. 1, the knitted part 1 is configured as a knee-high stocking 16. In addition to a foot part 20, this comprises a compressive leg part 21 preferably provided with a gradual pressure profile. In this case, the compressive pressure preferably decreases from distal to proximal. The foot part 20 here comprises a toe region 25, a mid-foot region 27, a heel region 24 and a region 28 surrounding the bone. It is also possible that the toe region 25 is configured to be open. In addition to an ankle region 30 and a calf region 23, the leg part 21 in turn has a band section 29 at its upper end which is preferably configured as a double-layer band. The stocking 16 here preferably consists of a circular or flat-knitted, preferably compressive knitted part 1.

The compressive pressures produced by the knee-high stocking 16 are preferably between 10 and 30 mmHg in an ankle region and between 5 and 20 mmHg in the calf region. The values are measured by means of the measurement method and measuring device described initially, in particular by means of testing on the HoSy measuring device (Hohenstein Institute).

On the inner side, the knitted part 1, in particular the foot part 20, now has a cushioning 9 consisting of a first and second cushioning layer 10, 11. The cushioning 9 extends here in the foot part 20 from the mid-foot region 27 as far as into the heel region 24. Furthermore, the cushioning 9 then continues in the leg part 21 and there overlaps the Achilles tendon region 26. The cushioning extends here both in the foot part 20 and also in the leg part 21 when viewed in the circumferential direction only in sections around the foot or leg of a wearer. This is therefore preferably only formed in the area of the sole of the foot 22 and the Achilles tendon and extends in this exemplary embodiment into the sides of the foot part 20 and leg part 21.

In this and in the following exemplary embodiments, the cushioning 9 is preferably formed by a knitted fabric 1 which differs from a region adjoining the cushioning 9 in relation to its type of binding. In the following FIG. 2 the structure of the cushioning 9, in particular in the region of the sole of the foot 22 is described in detail. For this purpose a stitch pattern of the knitted part 1 in section A is shown.

Figure 2:
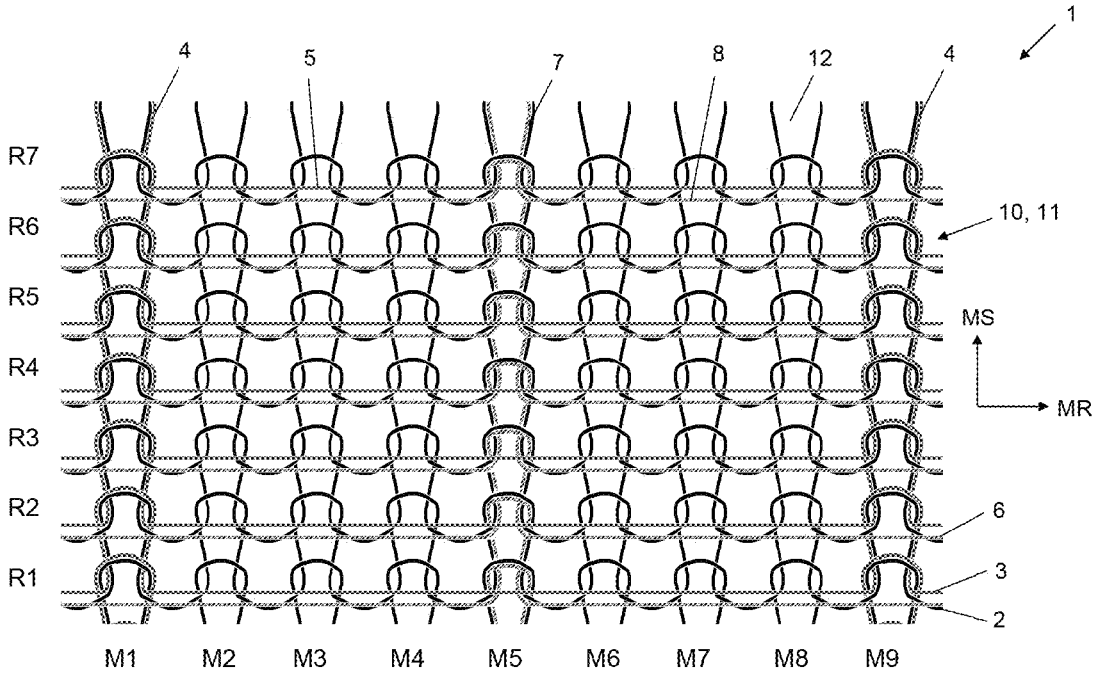
FIG. 2 shows a stitch pattern from section A from the first exemplary embodiment of the knitted part according to the invention according to FIG. 1.

The stitch pattern in FIG. 2 now shows a knitted part 1 consisting of a basic knitting thread 2 which is knitted in a stitch-forming manner over several knitting rows R1 to R7 and stitch wales M1 to M9. In addition to the basic knitting thread 2, the stitch pattern shows a first and second plating thread 3, 6 which are in part plated in a stitch-forming manner on the basic knitting thread 2 and floated over these to form respectively a first and second cushioning layer 10, 11. In this case, in particular the first plating thread 3 in each knitting row R1 to R7 is plated in a stitch-forming manner on the basic knitting thread 2 in the first and ninth stitch wales M1 and M9 and lies floating above the stitches located in between. This thread is therefore floated above the stitch wales M2 to M8 and thereby forms cushioning segments of a first cushioning layer 10 with a length of seven float stitches 5. The plating, i.e. the formation of stitches 4 of the first plating thread 3 in the stitch wales M1 and M9 on the basic knitting thread 2 serves to anchor or connect the first cushioning layer 10 to the basic knitted fabric 1.

The second plating thread 6 on the other hand is plated in a stitch-forming manner on the basic knitting thread 2 in each knitting row R1 to R7 in the fifth stitch wale M5, i.e. forms stitches 7 there. Since the stitch pattern only comprises a section A from the basic knitted fabric 1, the second point, i.e. the further stitch wale in which the second plating thread 6 is plated in a stitch-forming manner on the basic knitting thread 2 cannot be seen. Here however, a floating of the second plating thread 6 over seven stitches is preferably also accomplished here in order to form second cushioning segments of a second cushioning layer 11 having a length of seven float stitches 8. The number of successive stitches 12 over which the at least one first and second plating thread 3, 6 is floated can naturally be specified individually. In a knitting machine with up to 240 needles, a floating between 1 to 10 stitches is preferably accomplished. In a knitting machine with more than 240 needles the floating length is preferably between 1 to 12 stitches.

According to this exemplary embodiment but according to the following exemplary embodiments, the basic knitting thread 2 has a yarn count of 30 to 700 dtex, whereas the two plating threads 3, 6 have a yarn count of 30 to 300 dtex. Preferably the plurality of threads 2, 3, 6 consist of a plastic, in particular polyamide, polyester or polyurethane or of a natural fibre such as, for example, wool or cotton. Alternatively one of the threads 2, 3, 6, preferably the second plating thread 6, can also be an adhesive thread to give the knitted part 1 an anti-slip effect in addition to a cushioning property. In this case, the second plating thread 6 is preferably a silicone, elastane or rubber thread.

Furthermore, according to this exemplary embodiment but also according to the following exemplary embodiments, the first plating thread 3 can consist of a moisture-transporting yarn, namely a profiled yarn and the second plating thread 6 can consist of a moisture-absorbing yarn, namely a yarn with a rounded cross-section or conversely. As a result, an improved climate or moisture management of the knitted part 1 can be achieved.

As a result, a cushioned knitted part 1 with improved cushioning and damping properties can be formed by the previously described configuration. As described previously, this consists of at least two cushioning layers 10, 11 which each consist of a plurality of cushioning segments. The segments are formed by the plurality of float stitches 5, 8 and the first and second plating thread 3, 6 which come to rest one above the other on the left goods side of the knitted part 1. In this exemplary embodiment the float stitches 5, 8 form a flat cushioning.

Figure 3:
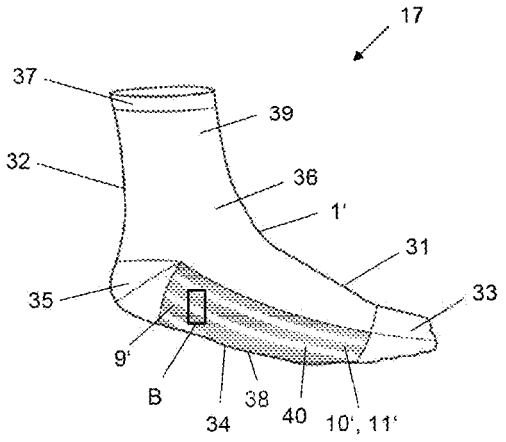
FIG. 3 shows a second exemplary embodiment of the knitted part according to the invention again configured as an item of leg clothing, in particular as a sock, also in side view.

FIG. 3 now shows a second exemplary embodiment of the knitted part 1' according to the invention in side view, again formed as an item of leg clothing, this time in the form of a sock 17. The sock 17 here also comprises a foot part 31 with a closed toe region 33, a mid-foot region 34, a heel region 35 and a region 36 surrounding the bone. In addition to a likewise preferably double-layer band section 37, the leg part 32 comprises an ankle region 39. At least the ankle region 39 is preferably also configured to be compressive in this exemplary embodiment. The compressive pressures produced in the ankle region 39 preferably lie between 10 and 30 mmHg.

In this exemplary embodiment, the sole of the foot 38 of the foot part 31 now has a knitted-in cushioning 9'. The cushioning 9' is here arranged in the foot part 31 between the toe region 33 and the heel region 35. Here also the cushioning 9' only extends in the circumferential direction in sections around the foot of a wearer. In addition to the sole of the foot 38, the sides of the foot are covered with the cushioning 9' at least in parts. According to the invention now according to this exemplary embodiment, the cushioning 9' now also forms a plurality of channels 40 on the inner side in addition to the plurality of cushioning layers 10', 11'. These serve to ventilate the knitted fabric 1' or the cushioning 9'. In the following FIG. 4 the knitted part 1', in particular the cushioning 9' with the plurality of channels 40 is described in detail by a section B with reference to a stitch pattern.

Figure 4:
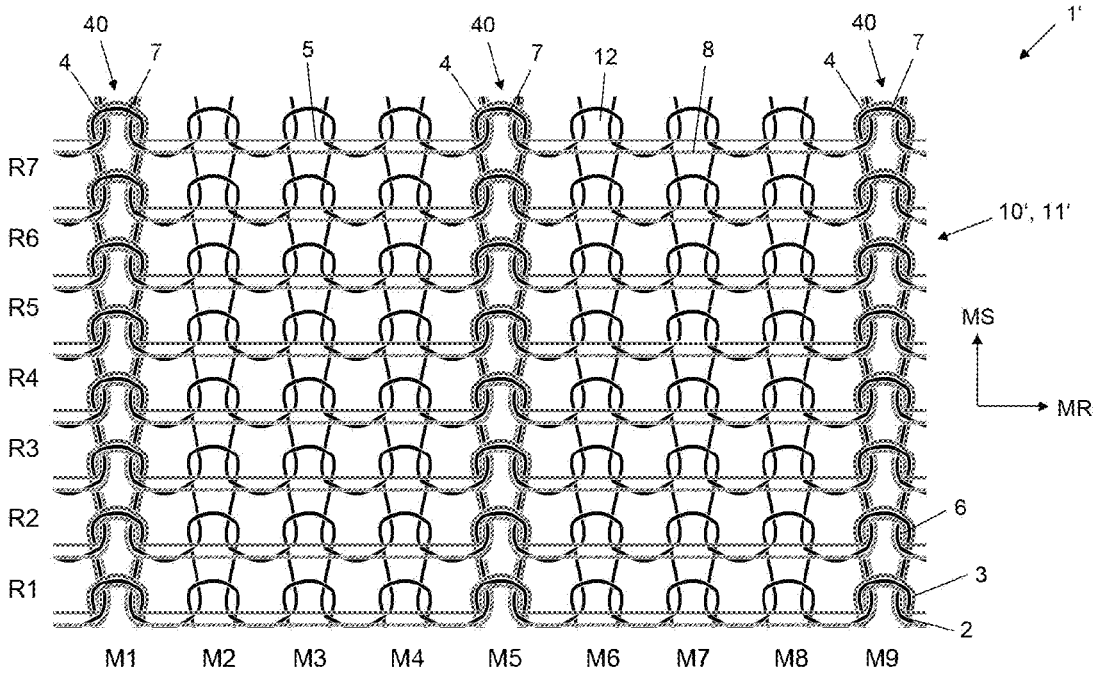
FIG. 4 shows a stitch pattern from section B from the second exemplary embodiment of the knitted part according to the invention according to FIG. 3.

As shown in FIG. 4, a basic knitting thread 2 is knitted in a stitch-forming manner over several stitch courses R1 to R7 and stitch wales M1 to M9. In this exemplary embodiment also two plating threads 3, 6 are plated in a stitch-forming manner on the basic knitting thread 2 and floated over this to form a first and second cushioning layer 10', 11'.

As can be seen in the stitch pattern, both the first and also the second plating threads 3, 6 in each knitting row R1 to R7 are plated in a stitch-forming manner 4, 7 in the first, fifth and ninth stitch wales M1, M5 and M9 on the basic knitting thread 2 and lie floating above the stitches 12 located in between. Both threads 3, 6 are therefore floated over the stitch wales M2 to M4 and M6 to M8 and thereby form cushioning segments for the first and second cushioning layer 10', 11' with a length of three float stitches 5, 8. The number of successive stitches 12 over which the two plating threads 3, 6 are floated can naturally also be specified individually in this exemplary embodiment.

An advantage of this configuration of the knitted part 1', in particular the cushioning is that as a result of the joint plating of the first and second plating threads 3, 6 on joint basic knitting machines 12, in addition to the plurality of cushioning layers 10', 11', a plurality of recesses or channels 40 are formed on the inner side of the knitted part 1'. These serve in particular to ventilate the knitted part 1' or the cushioning 9'. The recesses or channels 40 are formed by the joint plating of both threads 3, 6 on common stitches 12. By this means in these stitches 12 the thickness or strength of the knitted part 1' is not or only insignificantly changed since the plating threads 3, 6 in these stitches do not come to rest above the basic knitting stitches 12 but substantially only next to these stitches 12. In contrast to this, the float stitches 5, 8 lie outside and therefore above the basic knitting stitches 12 and thereby form a first and second cushioning layer 10', 11'. As a result, a three-ply or three-layer structure with preferably a plurality of recesses 40 is thereby formed.

Figure 5:
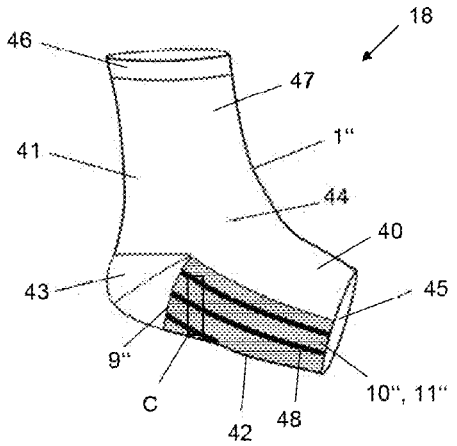
FIG. 5 shows a third exemplary embodiment of the knitted part according to the invention in the form of a bandage, in particular an ankle bandage, in side view.

FIG. 5 now shows a third exemplary embodiment of the knitted part 1" according to the invention in the form of a bandage, in particular an ankle bandage 18, also in side view. The ankle bandage 18 here comprises a foot part 40 and a leg part 41. The foot part 40 is formed here by a mid-foot region 42, a heel region 43 and a region 44 surrounding the bone. At the front end the bandage 18 has an opening 45 for the toes of a wearer. In addition to an ankle region 47, the leg part 41 comprises a terminating edge 46 which in the exemplary embodiment is preferably configured as single-layer. The bandage 18 can further comprise one or more support elements or pressure bodies for example in the form of an ankle pad. These are not shown. The bandage 18, in particular the base body preferably consists of a circular or flat-knitted knitted part 1". The knitted part 1" according to this exemplary embodiment can also be configured to be compressive. In addition, this comprises a cushioning 9" consisting of a first and second cushioning layer 10", 11" on the inner side in the region of the sole of the foot 42.

The cushioning 9" extends here in the foot part 40 along a mid-foot region 42 as far as a heel region 43. When viewed in the circumferential direction, the cushioning 9" is preferably also arranged at least in part on the sides of the foot of a wearer. According to this exemplary embodiment, the cushioning 9" also forms, in addition to the plurality of cushioning layers 10", 11", a plurality of rib-like elevations 48 on the inner side which extend along the sole of the foot 42. Naturally it is also feasible that these extend transversely to the sole of the foot 42. These elevations 48 give the knitted part 1" a locally massaging effect. In the next FIG. 6 the knitted part 1", in particular the cushioning 9" with the plurality of elevations 48 through the section C is described in detail with reference to a stitch pattern.

Figure 6:
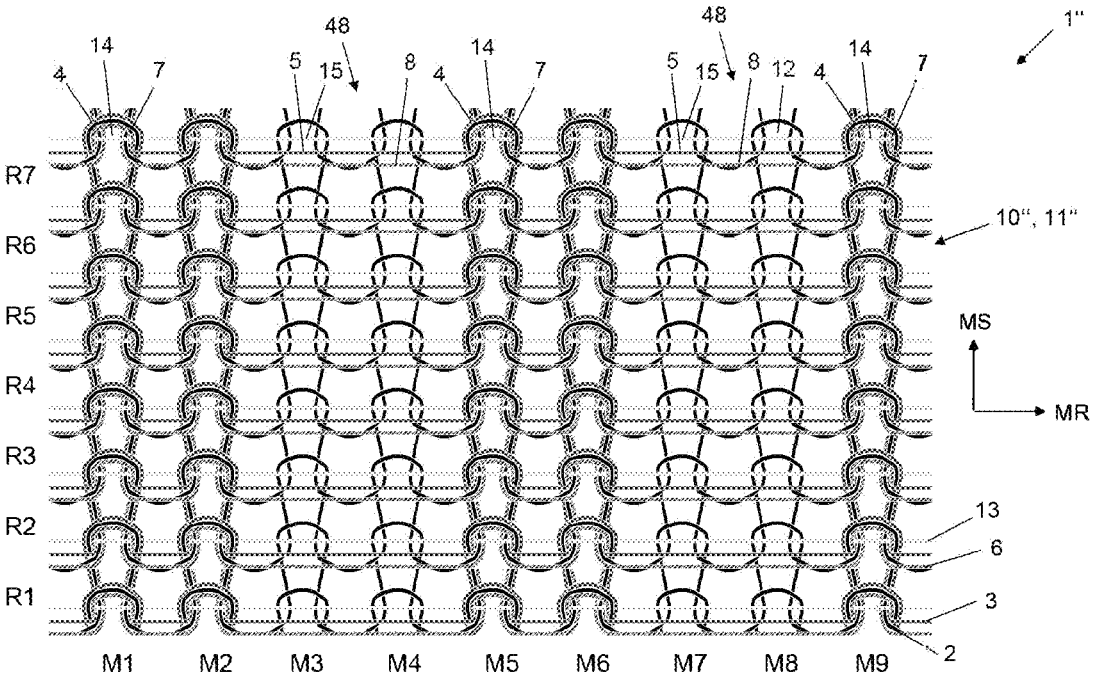
FIG. 6 shows a stitch pattern of a section C from the third exemplary embodiment of the knitted part according to FIG. 5.

In the knitted part 1" shown in FIG. 6, a basic knitting thread 2 is knitted in a stitch-forming manner over several knitting rows R1 to R7 and stitch wales M1 to M6. In addition to the two plating threads 3, 6 to form a first and second cushioning layer 10", 11", a further thread, namely an elastic thread 13 is inserted into the stitches 12 of the knitted part 1" formed by the basic knitting thread 2 via catch 14 and float 15. This thread is tied into the stitch wales M1 and M2, M5 and M6 as well as M9 via catch and floated over the stitch wales M3 and M4 as well as M7 and M8. The two plating threads 3, 6 are here plated in a stitch-forming manner 4, 7 in every knitting row R1 to R7 in the first and second, fifth and sixth and subsequently in the ninth stitch wales M1 and M2, M5 and M6 and M9 on the basic knitting thread 2 and lie floating above the stitches located in between. The threads 3, 6 are therefore likewise floated over the stitch wales M3 and M4 as well as M7 and M8 and in these stitch wales form cushioning segments for the first and second cushioning layer 10", 11" with a length of two float stitches 5, 8.

As a result of this configuration of the knitted part 1", in particular due to the float stitches 15 of the weft thread 13 and the float stitches 5, 8 of the first and second plating thread 3, 6 over common stitches or stitch wales of the basic knitting thread 2, the thickness or strength of the knitted part 1", i.e. the strength of the cushioning is significantly increased at these points, i.e. in the wales M3 and M4 as well as M7 and M8. As a result, in addition to the cushioning by the first and second cushioning layer 10", 11", rib-like elevations 48 are formed in this knitted part 1". These have a width of two float stitches. On the other side the plating threads 3, 6 are plated on common stitches 12. This has the result that, as described previously, the thickness or strength of the knitted part 1" is not changed or only changed insignificantly in these stitch wales M1 and M2, M5 and M6 and M9. Thus, a maximum difference in the thickness or strength of the knitted part 1" is obtained at the aforesaid stitch wales, with the result that the elevations or ribs 48 have a significant effect and thereby give the knitted part 1" a locally massaging effect, in particular on the sole of the foot of the wearer.

The elastic weft thread 13 incorporated into the knitted part 1" is here preferably incorporated into the knitted part 1" outside the cushioning 9". It therefore gives the knitted part 1", in particular the angle bandage 18, compressive properties, in particular in the ankle region 47. The compressive pressure values produced by the knitted part 1" are therefore, preferably in an ankle region 47 but also in the region of a cushioning 9", i.e. in a mid-foot region 42, between 5 and 60 mmHg, preferably between 10 and 45 mmHg.

Figure 7:
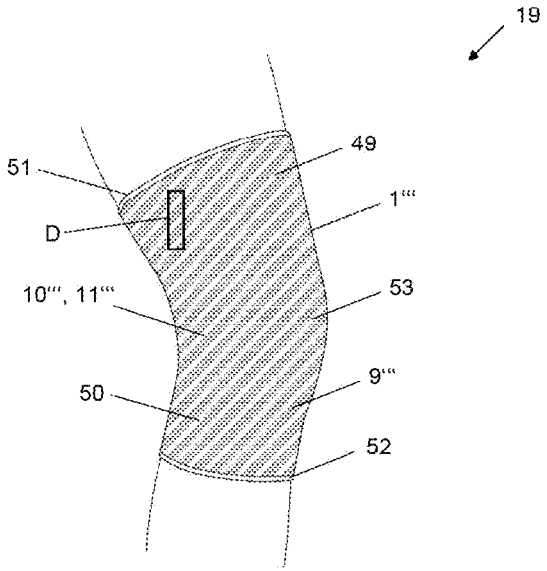
FIG. 7 shows a fourth exemplary embodiment of the knitted part according to the invention configured as a bandage or as a so-called sleeve, in particular for application to a knee of a wearer, also in side view.

FIG. 7 finally shows a fourth exemplary embodiment of the knitted part 1" according to the invention configured as a bandage 19 or as a so-called sleeve, in particular for application to a knee of a wearer, this also in side view. The preferably compressive knee bandage 19 shown substantially consists of a thigh part 49 and of a lower leg part 50. Both parts thereby enclose a patellar region. At the upper and lower end the bandage 19 furthermore has respectively one terminating edge 51 and 52. The knee bandage 19 is used to stabilize the joint. The bandage 19 here preferably consists of the tubular and compressive knitted part 1". In addition to the knitted part 1", the bandage 19 preferably has a knee pad not shown. This can be fastened detachably or non-detachably in or on the knitted part 1". Alternatively a separate pad can also be provided which can be positioned independently of the knitted part 1'" on the knee of a wearer. For this purpose on the side directed towards the wearer in the wearing position the pad preferably has an adhesive layer. Due to this self-adhesive surface the pad adheres to the skin of the wearer without any external aid.

The knitted part 1'" according to this exemplary embodiment now has a cushioning 9'" with a first and second cushioning layer 10'", 11'" on the inner side. The cushioning 9" extends here when viewed in the longitudinal direction over the entire length of the bandage 19, i.e. over the lower leg and thigh part 49, 50. Also when viewed in the circumferential direction, the cushioning 9'" is formed over the entire circumference on the inner side of the knitted part 1'". Thus, the entire knee bandage 19, i.e. the entire inner side, is provided with the cushioning 9". According to this exemplary embodiment, the cushioning 9'" again forms on the inner side a plurality of channels 53 for ventilation of the knitted fabric 1'" or the cushioning 9'". In contrast to the channels 40 described in FIG. 3, these ventilation channels 43 now run obliquely to the longitudinal extension of the bandage 19 and therefore also obliquely to the stitch wales direction MR of the basic knitted fabric 1'". In the now following FIG. 8 the knitted part 1'", in particular the structure of the cushioning 9'" with the plurality of channels 48 is now described in detail in a section D.

Figure 8:
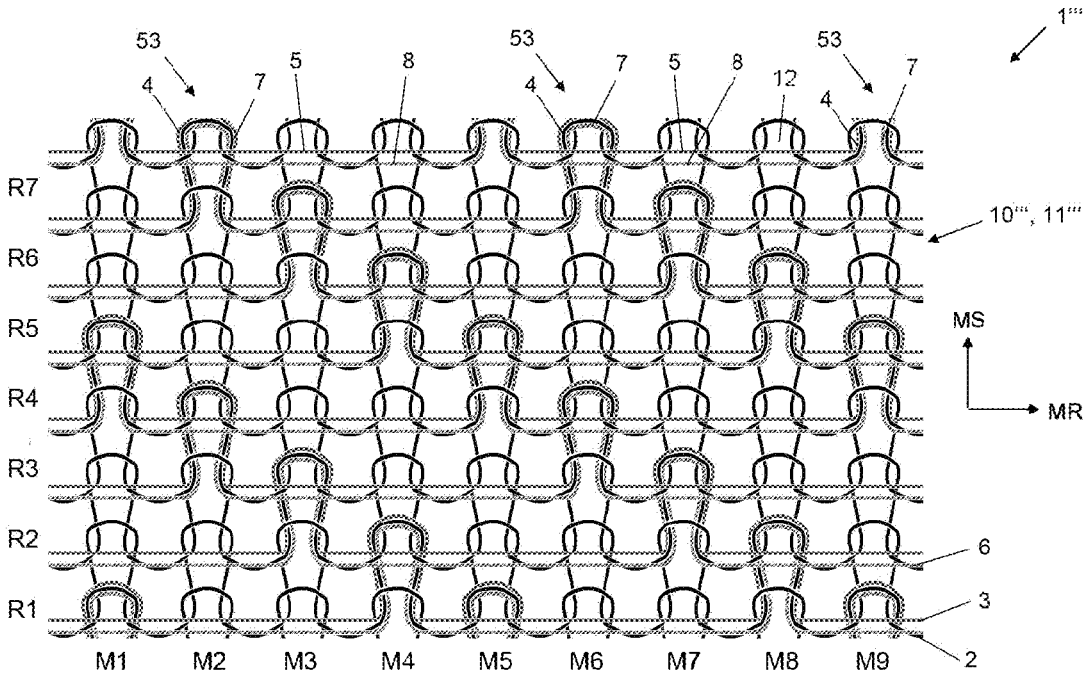
FIG. 8 shows a stitch pattern of a section D from the fourth exemplary embodiment of the knitted part according to the invention according to FIG. 7.

The stitch pattern from FIG. 8 shows a basic knitting thread 2 which is knitted in a stitch-forming manner over several knitting rows R1 to R7 and stitch wales M1 to M9. In addition, two plating threads 3, 6 are also plated here in a stitch-forming manner on the basic knitting thread 2 and floated over this to form respectively a first and second cushioning layer 10", 11'". Here the first and second plating thread 3, 6 in the stitch course R7 in the second and sixth stitch wale M2 and M6 is plated in a stitch-forming manner on the basic knitting thread 2. Between these stitches M2 and M6 both plating threads 3, 6 lie floating above the basic knitting stitches 12 formed in between. They thus form cushioning segments of a first and second cushioning layer 10'", 11'" with a length of three float stitches 5, 8.

In a second stitch course R2 the stitches M4 and M8 from row R1 on which both the first and also the second plating thread is plated in a stitch-forming manner are arranged offset by one stitch wale in the knitted part 1'". These stitches are therefore located in stitch course R2 at the position M3 and M7. As a result of this offset which is continued in the following stitch courses R3 to R7, a cushioning is formed which comprises a plurality of ventilation channels 53 running obliquely to the stitch wales direction MR.

Figure 9:
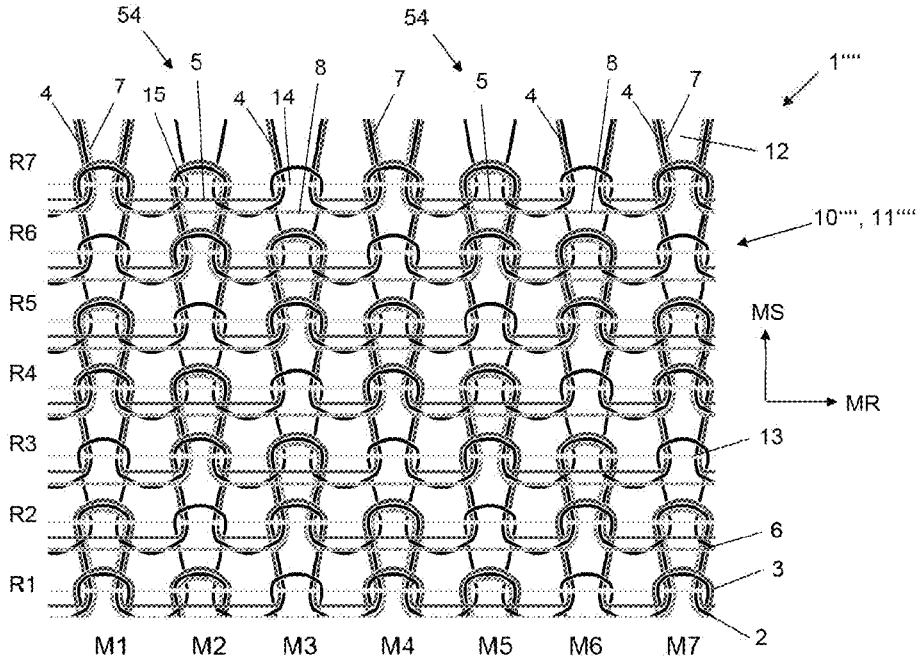
FIG. 9 shows a further stitch pattern of a further possible exemplary embodiment of the knitted part according to the invention.

FIG. 9 finally shows a further stitch pattern of a further possible exemplary embodiment of the knitted part 1'" according to the invention. In this, a basic knitting thread 2 is again knitted in a stitch-forming manner over several knitting rows R1 to R7 and stitch wales M1 to M7. In addition, an elastic weft thread 13 is inserted into the stitches 12 of the basic knitted part 1" formed by the basic knitting thread 2 via catch 14 and float 15. In order to form a first cushioning layer 10" a first plating thread 3 is now incorporated in each knitting row R1 to R7. In the stitch course R7 the plating thread 3 is plated in a stitch-forming manner in the first, third, fourth, sixth and seventh stitch wales M1, M3, M4, M6 and M7 on the basic knitting thread 2 and lies floating above the stitches located in between. It is therefore floated over the stitch wales M2 and M5 and thereby forms cushioning segments of a first cushioning layer with a length of one float stitch 5.

The second plating thread 6 is also present in each knitting row R1 to R7. This thread is plated in a stitch-forming manner in the stitch course R7 in the first, fourth and seventh stitch wales M1, M4 and M7 on the basic knitting thread 2. This thread is floated over the stitch wales M2 and M3 as well as M5 and M6 to form second cushioning segments of a second cushioning layer 11"" with a length of two float stitches 8. Thus, the number of successive stitches 12 over which the second plating thread 6 lies floating is greater than the number of successive stitches 12 over which the first plating thread 3 lies floating. This has the advantage that it is thereby ensured that in each case the second plating thread 6 comes to lie above the first plating thread 3.

Since according to this exemplary embodiment also both plating threads 3, 6 are plated in a stitch-forming manner on common stitches 12, this cushioning 9"" also forms a plurality of recesses or channels 54 on the inner side of the knitted part 1"" which serve to ventilate the knitted part 1"" or the cushioning 9"". Since in addition, the plurality of stitches on which the first and/or second plating threads 3, 6 are plated in a stitch-forming manner is arranged in the knitted part 1"" offset by a stitch wale in the stitch wale direction MS, a cushioning 9"" is also formed in this exemplary embodiment wherein the plurality of ventilation channels 54 run obliquely to the stitch wale direction MR.

The invention is not restricted to the exemplary embodiments described but comprises all embodiments which apply or include the fundamental corresponding functioning principle of the invention. Furthermore all the features of all the exemplary embodiments described and presented can be combined with one another.

The invention claimed is:

1. A knitted part consisting of at least one stitch-forming thread as well as at least one first and second plating thread, wherein to form a first cushioning layer a first plating thread is plated in a stitch-forming manner at least in sections in a stitch course direction (MR) on a basic knitting thread and lies floating over one or more basic knitting stitches formed by the basic knitting thread, wherein to form at least one second cushioning layer the second plating thread is plated in a stitch-forming manner at least in sections in the stitch course direction (MR) on the basic knitting thread or the first plating thread and lies floating over one or more float stitches formed by the first plating thread, and wherein the number of successive stitches over which the second plating thread lies floating is greater than the number of successive stitches over which the first plating thread lies floating.

2. The knitted part according to claim 1, wherein the at least one first and second plating thread is plated in a stitch-forming manner on stitches formed by the basic knitting thread.

3. The knitted part according to claim 2, wherein the stitches on which the first and second plating thread is plated in a stitch-forming manner are arranged offset in the stitch wales direction (MR) from stitch course to stitch course in the knitted part.

4. The knitted part according to claim 1, wherein at least one elastic weft thread is inserted via catch and float into the stitches of the knitted part formed by the basic knitting thread or is knitted with the basic knitting thread in a stitch-forming manner.

5. The knitted part according to claim 4, wherein the float stitch of the weft thread and the float stitches of the first or second plating thread are floated jointly over stitches formed by the basic knitting thread.

6. The knitted part according to claim 1, wherein the number of successive stitches over which the at least one first and second plating thread is floated is between 1 to 10 stitches.

7. The knitted part according claim 1, wherein the at least one basic knitting thread and the first plating thread consist of a moisture-transporting yarn and the second plating thread consists of a moisture-absorbing yarn.

8. The knitted part according to claim 1, wherein a third plating thread is plated in a stitch-forming manner and/or lies floating at least in sections in the stitch course direction (MR) on or over the basic knitting thread or the first plating thread or the second plating thread.

9. The knitted part according to claim 1, wherein the plurality of plating threads are incorporated only in sections in the knitted part in the stitch course direction (MR) and their ends are locked in the basic knitting stitches of the knitted.

10. The knitted part according to claim 1, wherein the basic knitting thread as well as the plurality of plating threads consist of plastic, polyester or polyurethane, silicone or of a natural fibre.

11. The knitted part according to claim 1, wherein the at least one basic knitting thread has a yarn count of 30 to 700 dtex, the plurality of plating threads have a yarn count of 30 to 300 dtex and the at least one weft thread has a yarn count of 200 dtex to 700 dtex.

12. The knitted part according to claim 1, wherein the knitted part is a stocking, a sock, a glove, a bandage, or a compressive element of an orthosis.

13. The knitted part according to claim 12, wherein when forming the knitted part as a stocking, sock, or bandage the at least one first and second cushioning layer is incorporated in a sole, calf, heel, toe or Achilles tendon region.

14. The knitted part according to claim 1, wherein the compressive pressure values produced by the knitted part are between 5 and 60 mmHg.

15. The knitted part according to claim 3, wherein the offset is by one stitch wale (MS).

16. The knitted part according to claim 1, wherein the number of successive stitches over which the at least one first and second plating thread is floated is 2 to 6 stitches in a knitting machine with up to 240 needles.

17. The knitted part according to claim 1, wherein the number of successive stitches over which the at least one first and second plating thread is floated is 1 to 12 in a knitting machine with more than 240 needles.

18. The knitted part according to claim 8, wherein the third plating thread is a pattern or function thread.

19. The knitted part according to claim 1, wherein the compressive pressure values produced by the knitted part are between 10 and 45 mmHg.

20. A knitted part consisting of at least one stitch-forming thread as well as at least one first and second plating thread, wherein to form a first cushioning layer a first plating thread is plated in a stitch-forming manner at least in sections in a stitch course direction (MR) on a basic knitting thread and lies floating over one or more basic knitting stitches formed by the basic knitting thread, wherein to form at least one second cushioning layer the second plating thread is plated in a stitch-forming manner at least in sections in the stitch course direction (MR) on the basic knitting thread or the first plating thread and lies floating over one or more float stitches formed by the first plating thread, and wherein each of the first plating thread and the second plating thread which are jointly floated over the basic knitting stitches are plated at different stitches in a stitch-forming manner on the basic knitting.

* * * * *